US008998277B2

(12) United States Patent
Jeong et al.

(10) Patent No.: US 8,998,277 B2
(45) Date of Patent: Apr. 7, 2015

(54) OUTSIDE HANDLE FOR SLIDING DOOR

(71) Applicant: Kia Motors Corporation, Seoul (KR)

(72) Inventors: Ki Hwan Jeong, Seoul (KR); Chi Young Min, Gyeonggi-do (KR); Myoung Kwon Je, Seoul (KR)

(73) Assignee: Kia Motors Corporation, Seoul (KR)

( * ) Notice: Subject to any disclaimer, the term of this patent is extended or adjusted under 35 U.S.C. 154(b) by 0 days.

(21) Appl. No.: 13/789,636

(22) Filed: Mar. 7, 2013

(65) Prior Publication Data

US 2014/0159391 A1 Jun. 12, 2014

(30) Foreign Application Priority Data

Dec. 11, 2012 (KR) ..... 10-2012-0143648

(51) Int. Cl.

| | |
|---|---|
| ***E05B 3/00*** | (2006.01) |
| ***E05B 85/10*** | (2014.01) |
| ***E05B 83/40*** | (2014.01) |
| ***E05B 85/16*** | (2014.01) |

(52) U.S. Cl.

CPC ..... *E05B 85/10* (2013.01); *E05B 83/40* (2013.01); *E05B 85/16* (2013.01)

(58) Field of Classification Search

USPC ..... 292/336.3, DIG. 53, DIG. 54, DIG. 22, 292/DIG. 65; 16/110.1, 412; 296/155

See application file for complete search history.

(56) References Cited

FOREIGN PATENT DOCUMENTS

| | | | |
|---|---|---|---|
| DE | 19508518 | A1 * | 9/1996 |
| JP | 2002322833 | A * | 11/2002 |
| JP | 2007-085032 | A | 4/2007 |
| KR | 20110139353 | A | 12/2011 |
| KR | 20120046650 | A | 5/2012 |
| KR | 101163471 | B1 | 7/2012 |

* cited by examiner

*Primary Examiner* — Kristina Fulton
*Assistant Examiner* — Christine M Mills
(74) *Attorney, Agent, or Firm* — McDermott Will & Emery LLP

(57) ABSTRACT

An outside handle for a sliding door includes a base member, a grip member, and a lever. The base member is mounted on a door panel and has a first hole formed at one end thereof. The grip member is rotatably and slidably mounted to the base member and has a first hook formed at one end thereof, the first hook being inserted into the first hole. The lever is connected to the first hook of the grip member and is positioned in the first hole of the base member to enable rotation and sliding of the lever in response to rotation and sliding of the grip member. The outside handle improves the operation convenience and ease of assembly of outside handles for sliding doors.

5 Claims, 11 Drawing Sheets

<Prior Art>

<Prior Art>

OUTSIDE HANDLE FOR SLIDING DOOR

CROSS-REFERENCE TO RELATED APPLICATION

This application is based on and claims priority from Korean Patent Application No. 10-2012-0143648, filed on Dec. 11, 2012 in the Korean Intellectual Property Office, the disclosure of which is incorporated herein in its entirety by reference.

BACKGROUND OF THE INVENTION

1. Field of the Invention

The present invention relates to an outside handle for a sliding door, and more particularly, to an outside handle for a sliding door that is mounted in the sliding door and is rotated and slid to allow the sliding door to be opened or closed.

2. Description of the Prior Art

Generally, in the case of a passenger vehicle, a grip of an outside handle is exposed at an outer portion of a door panel in order to open or close the door. A door latch assembly which can be latched or unlatched by a unit such as a remote controller, a key, or the like, is mounted at an inner portion of the door panel.

In cases in which a user is to open the door from the outside of the vehicle, when he/she presses an opening button of the remote controller, a solenoid within the door latch assembly receives a signal from the remote controller that causes the solenoid to move in such a way as to cause the door latch assembly to become unlatched. Then, when the user pulls the outside handle of the door in the direction in which the door is opened, the door can open.

In situations in which the door is opened as shown in FIG. 1, since a direction in which a force is applied to the handle and a direction in which the door is opened are the same, a problem does not occur. However, when the door is closed as shown in FIG. 2, since the outside handle is pulled in one direction to unlatch the door and is then pushed in an opposite direction in order to close the door, the operation of the door handle is inconvenient and unnatural.

SUMMARY OF THE INVENTION

Accordingly, the present invention has been made to solve the above-mentioned problems occurring in the prior art while maintaining the advantages achieved by the prior art.

One goal achieved by the present invention is to provide an outside handle for a sliding door, and more particularly, an outside handle for a sliding door that is mounted in the sliding door and is rotated and slid to allow the sliding door to be opened or closed.

In one aspect of the present invention, the outside handle for a sliding door includes: a base member mounted on a door panel and having a first hole formed at one end thereof; a grip member rotatably and slidably mounted to the base member and having a first hook formed at one end thereof, the first hook being inserted into the first hole; and a lever connected to the first hook of the grip member and positioned in the first hole of the base member to enable rotation and sliding of the lever in response to rotation and sliding of the grip member.

The base member may have a second hole formed at the other end thereof, and the grip member may have a second hook formed at the other end thereof, wherein the second hook is inserted into the second hole.

The lever may include: a shaft rotatably and slidably inserted into the first hole of the base member; and a hooked part which protrudes from the shaft in a transverse direction and into which the first hook of the grip member is inserted.

The shaft may have an elastic body attached thereto.

The base member may be provided with a guide configured to enable the lever to rotate and slide laterally along the shaft.

One end of the lever may be provided with a cable fixing part.

An inner portion of the first hole may have a grip arm mounted therein, such that the grip arm connects the first hook of the grip member to the lever.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Exemplary embodiments of the present invention will be described in detail with reference to the accompanying drawings.

An outside handle for a sliding door according to an exemplary embodiment of the present invention is configured to include a base member 100 mounted on a door panel, a grip member 200 rotatably and slidably mounted to the base member 100, and a lever 300 configured to move in response to the rotation and sliding of the grip member 200 with respect to the base member 100, as shown in FIGS. 3 to 12.

Figure 1:
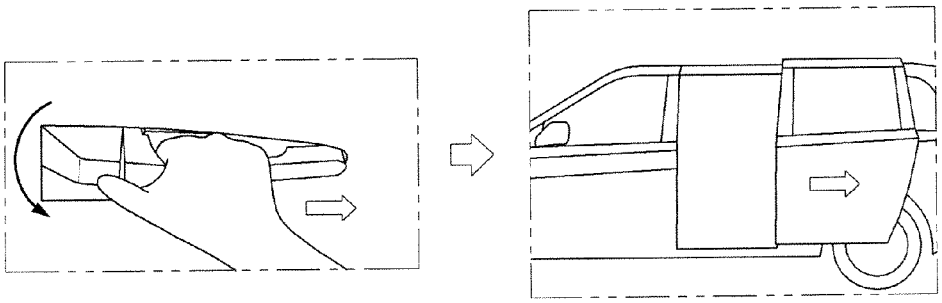
FIG. 1 is an illustration showing an outside handle for a sliding door being operated to open the sliding door.
Figure 2:
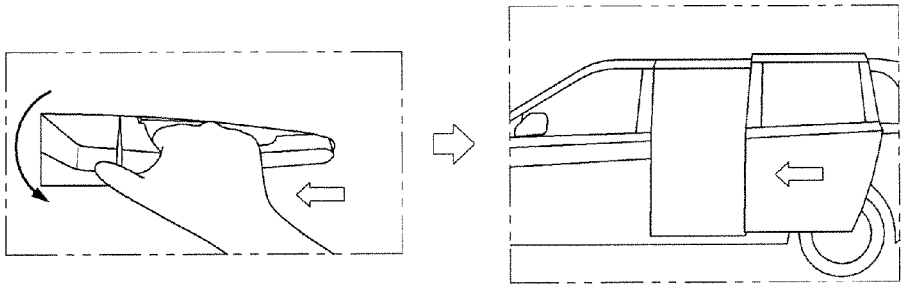
FIG. 2 is an illustration showing the outside handle for a sliding door being operated to close the sliding door.
Figure 3:
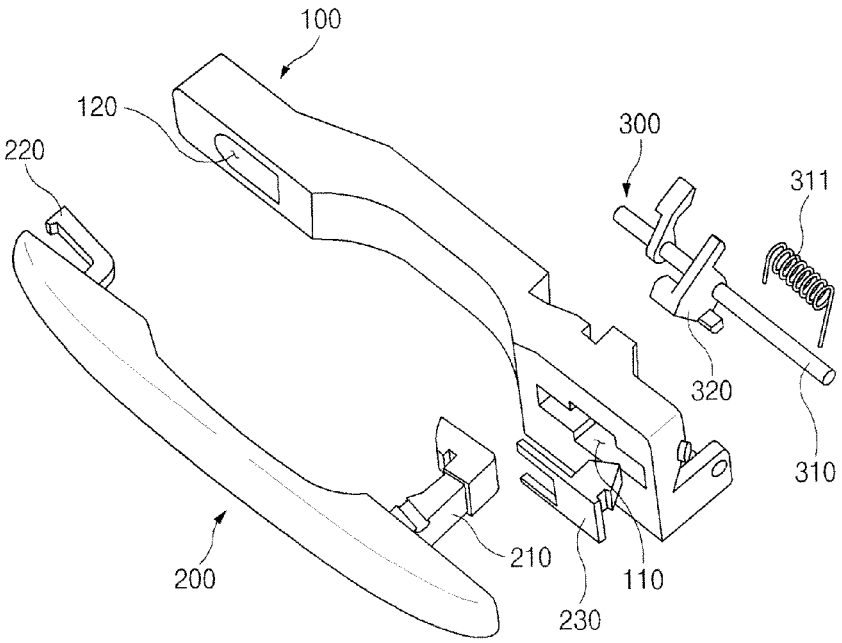
FIG. 3 is an exploded perspective view showing an outside handle for a sliding door according to an exemplary embodiment of the present invention.
Figure 4:
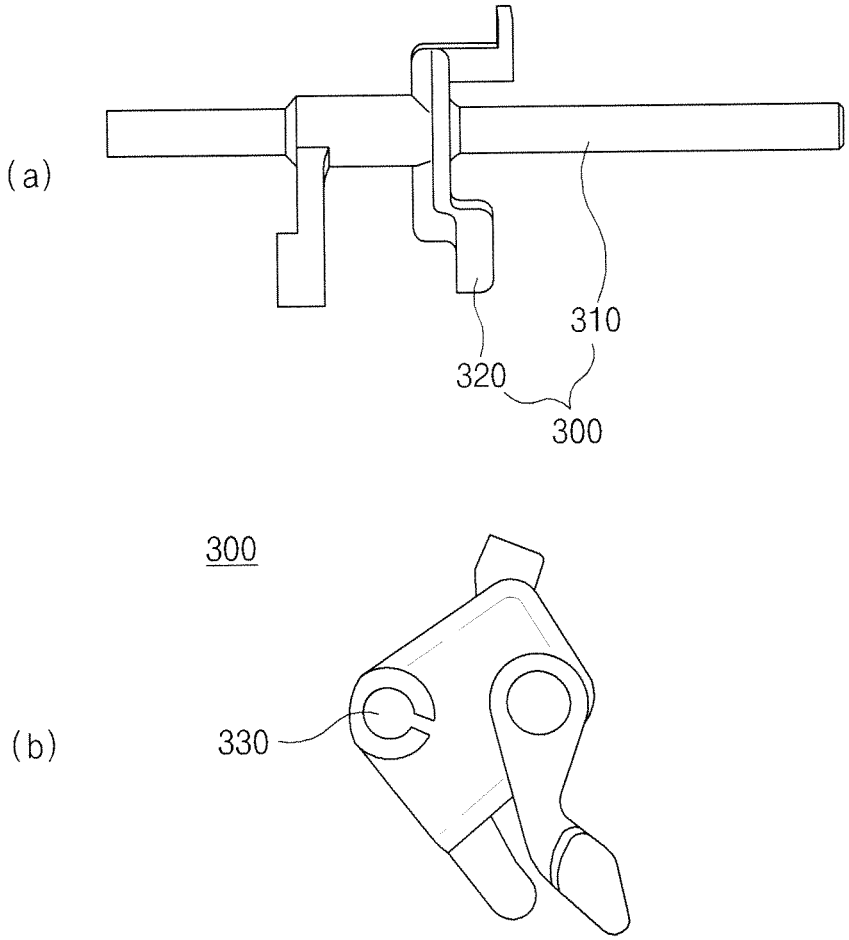
FIGS. 4A and 4B are views showing a lever forming part of the outside handle for a sliding door according to the exemplary embodiment of the present invention.

As shown in FIG. 3, an outer side of the base member 100 has mounted thereon a grip member 200 (described in more detail below), and an inner side of the base member 100 is fixedly mounted to the door panel. In various examples, the base member 100 can be mounted to the outside of a door panel, or the base member 100 can be mounted inside a door panel such the grip member 200 mounted to the base member 100 remains outside of the door panel.

The base member 100 has a first hole 110, formed at one end thereof, that penetrates therethrough and has a second hole 120, formed at the other end thereof, that also penetrates therethrough.

The grip member 200, which can take the form of a handle mounted on the sliding door, is rotatably and slidably attached to the base member 100. In one example, when the two members are attached, the grip member 200 can rotate with respect to the base member 100 such that one end of the grip member 200 rotates outwardly from the base member 100 (and from a door panel to which the base member 100 is attached), while the opposite end of the grip member 200 remains in contact with the base member 100. In particular, the one end of the grip member 200 rotates outwardly from a first position in contact with the base member 100 to a second position spaced away from the base member 100. In the one example, axis of rotation of the grip member 200 is parallel to a plane of a door panel on which the base member 100 is attached.

The grip member 200 has a first hook 210 formed at one end thereof and has a second hook 220 formed at the other/opposite end thereof, wherein the first hook 210 is inserted into the first hole 110 of the base member 100 and the second hook 220 is inserted into the second hole 120 of the base member 100 when the grip member 200 is mounted on the base member 100.

Here, the first hook 210 is formed to have a predetermined length sufficient to allow the first hook 210 to contact a lever 300 (described in more detail below) that is attached to the base member 100, and to hook the lever 300 such that the lever 300 becomes inserted inside the first hook 210.

In addition, an inner portion of the first hole 110 of the base member 100 may have a grip arm 230 mounted therein. The grip arm 230 connects the first hook 210 of the grip member 200 and the lever 300 to each other to provide additional strength and improve the operation of the grip member 200.

As shown in FIGS. 3, 4A, and 4B, the lever 300 is positioned in the inner portion of the first hole 110 when the lever 300 is in a state in which it is connected to (or hooked by) the first hook 210 of the grip member 200. The lever 300 is positioned so as to be rotated and slid laterally in response to the rotation and sliding of the grip member 200 with respect to the base member 100.

The lever 300 may include a shaft 310 rotatably and slidably inserted into the first hole 110 of the base member 100, such that the lever 300 and shaft 310 can rotate and slide with respect to the base member 100 (and with respect to the first hole 110). In particular, the lever 300 can rotate around the axis of the shaft, and can slide along the axis of the shaft. The lever 300 may also include a hooked part 320 which protrudes from the shaft 310 in a transverse direction, and into which the first hook 210 of the grip member 200 can be inserted (though in an alternate embodiment, the hooked part 320 may itself be hooked into the first hook 210).

The shaft 310 may further be mounted with an elastic body 311 (e.g., a spring) which can be used to automatically return the grip member 200 (connected to the lever 300) to its original position after the rotation and the sliding of the grip member 200.

Figure 8:
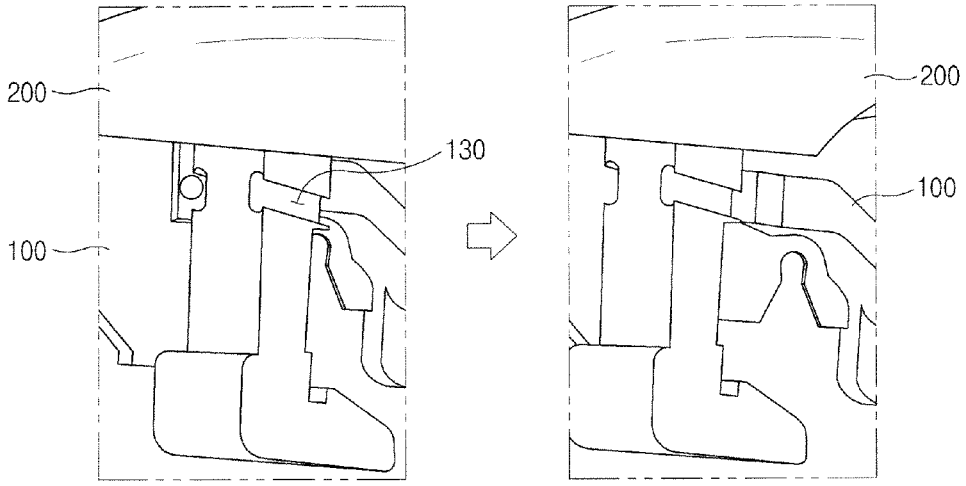
FIG. 8 is a view showing a guide formed in the base member, and a grip member held and guided by the guide, in the outside handle for a sliding door according to the exemplary embodiment of the present invention.

Meanwhile, as shown in FIG. 8, the base member 100 is provided with a guide 130 (e.g., formed as a groove). When the grip member 200 is slid laterally, the grip arm 230 slides along the guide 130 of the base member 100 at a predetermined angle determined by an angle of the guide 130.

When the outside handle for a sliding door according to the exemplary embodiment of the present invention is slid laterally, the grip member 200 slides laterally by a predetermined distance while being popped up from (or rotated away from) the base member 100. The guide 130 serves to hold and stabilize the grip member 200 with respect to the base member 100 while the grip member 200 is slid, thereby minimizing noise and providing a more stable and solid connection between the base and grip members forming the handle.

In addition, as shown in FIGS. 4A and 4B, one end of the lever 300 is provided with a cable fixing part 330. Therefore, when an operation of pulling the grip member 200 is performed (e.g., so as to cause the grip member 200 to rotate outwardly with respect to the base member 100), the first hook 210 of the grip member 200 engages and pulls on the hooked part 320 of the lever, thereby causing the lever 300 to be rotated around the axis of the shaft 310. The rotation of the lever 300 can thus cause a cable connected thereto to be pulled. In addition, when an operation of sliding the grip member 200 is performed (either in conjunction with the rotation of the grip member 200, or separately from the rotation of the grip member 200), the lever 300 is also caused to slide together with the grip member 200 and to pull on the cable. Thus, the movement of the grip member 200 can be transferred, through the lever 300 and the cable, to a latch (not shown) connected to the cable, thereby making it possible to unlock the sliding door.

Figure 7:
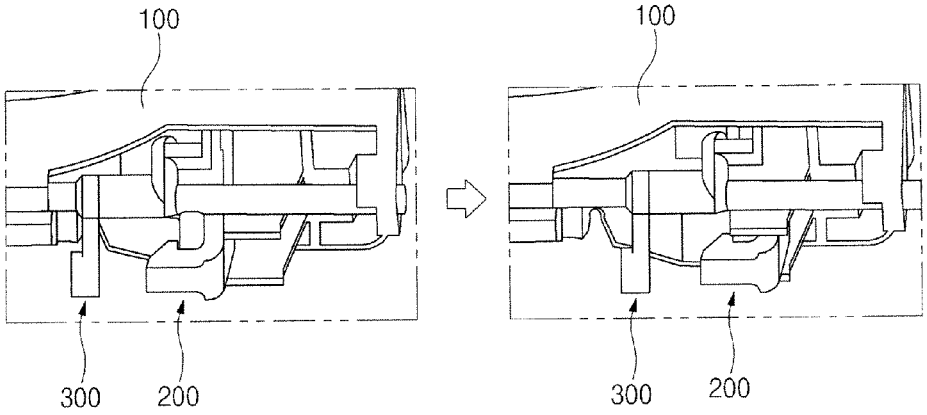
FIG. 7 is a view showing a lever and a grip arm that are coupled to each other and located in an inner portion of a base member of the outside handle for a sliding door according to the exemplary embodiment of the present invention.

That is, as shown in FIG. 7, when the grip member 200 is slid in a state in which the grip arm 230 and the lever 300 are hooked, engaged, or otherwise fixed to each other, the grip arm 230 is moved together with the lever 300. Therefore, the cable connected to the lever 300 is pulled to transfer the same stroke to the latch (not shown). When a predetermined amount of stroke is transferred to the latch, a door lock is released, such that the sliding door may be opened.

Meanwhile, since the grip member 200 is configured to be separatable from the base member 100, it may be repaired after being separated from the base member, such that the ease of repair of the outside handle is improved.

Hereinafter, the operation and resulting effect of the present invention will be described.

Figure 5:
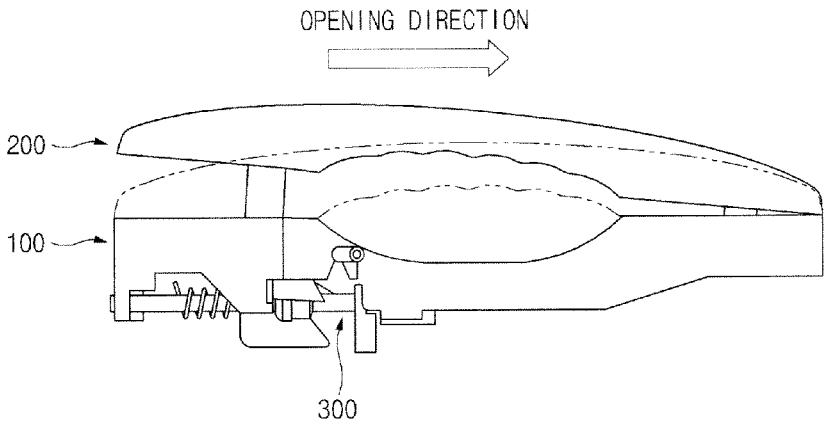
FIG. 5 is an illustration showing the outside handle for a sliding door according to the exemplary embodiment of the present invention being operated to open the sliding door.
Figure 9:
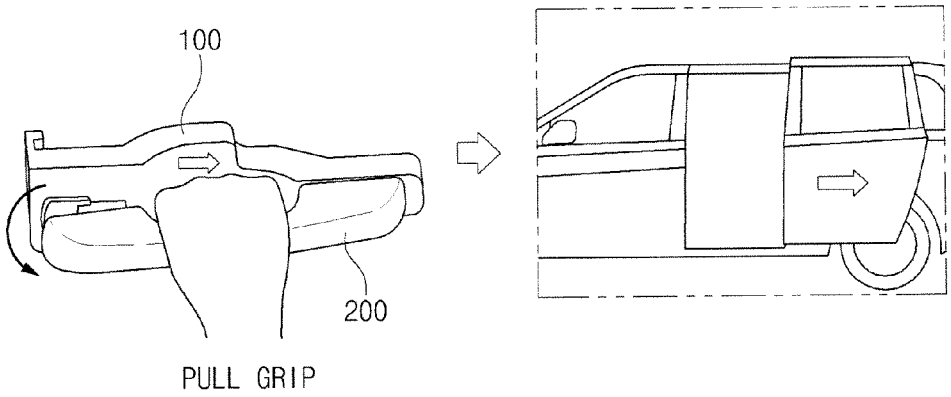
FIG. 9 is an illustration showing the grip member being pulled in the outside handle for a sliding door according to the exemplary embodiment of the present invention so as to cause the opening of the sliding door.

As shown in FIGS. 5 and 9, in the case in which the opening of a sliding door requires sliding the door in a rightward direction (as shown as the "opening direction" in FIG. 5), one side of the grip member 200 provided with the first hook 210 is rotated away from the base member 100 and the grip member 200 is then slid toward the second hook 220 to open the sliding door. In the example of FIG. 5, one end of the grip member 200 provided with the first hook 210 is shown in the left-hand portion of the figure, while the other/opposite end of the grip member 200 provided with the second hook 220 is shown in the right-hand portion of the figure.

Figure 6:
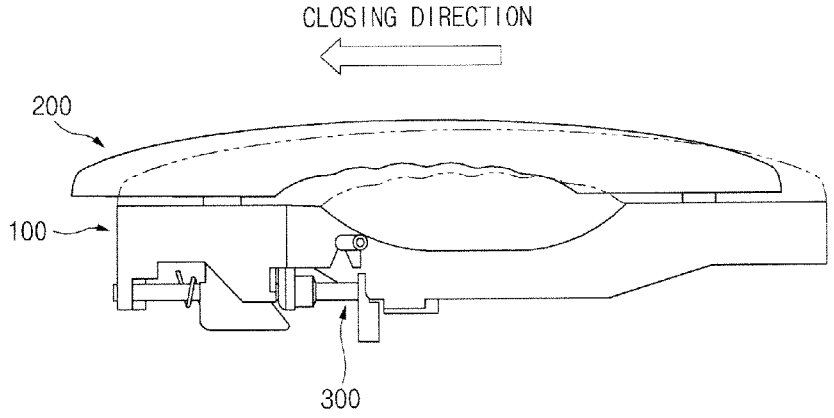
FIG. 6 is an illustration showing the outside handle for a sliding door according to the exemplary embodiment of the present invention being operated to close the sliding door.
Figure 10:
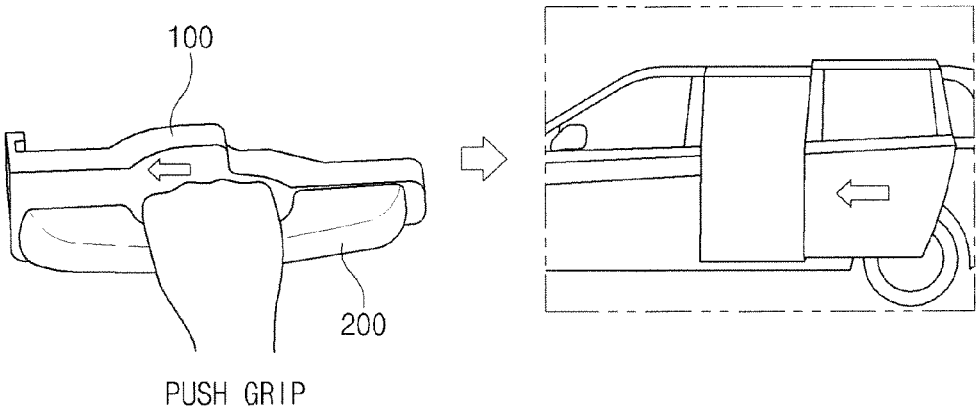
FIG. 10 is an illustration showing the grip member being slid laterally in the outside handle for a sliding door according to the exemplary embodiment of the present invention so as to cause the closing of the sliding door.

Meanwhile, as shown in FIGS. 6 and 10, in the case in which the closing of a sliding door requires sliding the door in a leftward direction (as shown as the "closing direction" in FIG. 6), the grip member 200 is slid in the leftward direction in which the sliding door is closed. The grip member 200 need not be rotated to close the sliding door.

Figure 11:
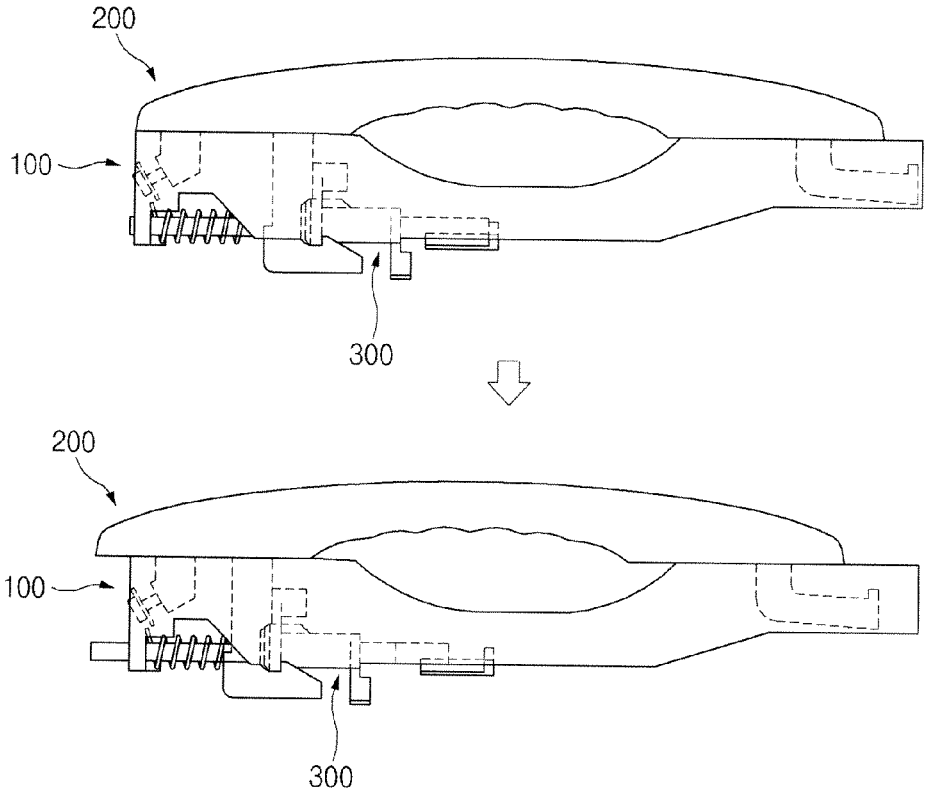
FIG. 11 is an illustration showing the grip member being slid laterally in the outside handle for a sliding door according to the exemplary embodiment of the present invention.
Figure 12:
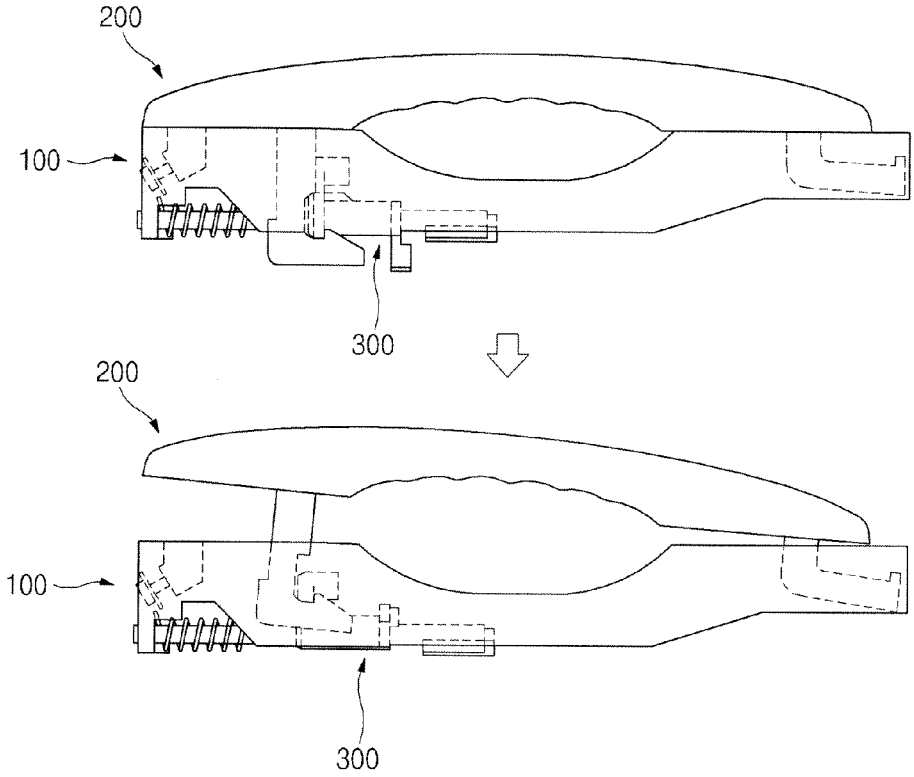
FIG. 12 is an illustration showing the grip member being rotated in the outside handle for a sliding door according to the exemplary embodiment of the present invention.

That is, according to the exemplary embodiment of the present invention, in the case in which the grip member 200 is slid as shown in FIG. 11, it is slid without necessarily requiring that the first hook 210 engage and pull on lever 300, such that it is easily slid without rotation. Hence, the operation of pulling and rotating the grip member 200 as shown in FIG. 12 may be performed only in the case in which the sliding door is opened.

According to the exemplary embodiment of the present invention as described above, it is possible to improve the operation, convenience, and ease of assembly of the outside handle of a sliding door used for opening and closing the sliding door.

As described above, although the present invention has been described with reference to illustrative embodiments shown in the accompanying drawings, the present invention is not limited to those particular embodiments. Thus, various modifications and alterations can be made without departing from the scope defined in the following claims.

What is claimed is:

1. An outside handle for a sliding door, the outside handle comprising:

a base member mounted on a door panel and having a first hole formed at one end thereof;

a grip member rotatably and slidably mounted to the base member and having a first hook formed at one end thereof, the first hook being inserted into the first hole; and a lever connected to the first hook of the grip member and positioned in the first hole of the base member enabling rotation and sliding of the lever in response to rotation and sliding of the grip member with respect to the base member, wherein the first hook has a guide groove formed thereon enabling the lever to rotate and slide laterally along a shaft, wherein the first hook is formed in an 'L' shape, and the first hook moves the shaft to a direction of movement of the lever when the lever slides in parallel with the sliding door, and wherein the lever comprises:

the shaft rotatably and slidably inserted into the first hole of the base member; and a hooked part which protrudes from the shaft in a transverse direction and into which the first hook of the grip member is inserted.

2. The outside handle according to claim 1, wherein the base member has a second hole formed at another end thereof, and the grip member has a second hook formed at another end thereof, and the second hook is inserted into the second hole.

3. The outside handle according to claim 1, wherein the lever comprises an elastic body attached to the shaft.

4. The outside handle according to claim 1, wherein one end of the lever is provided with a cable fixing part.

5. The outside handle according to claim 1, further comprising a grip arm mounted in an inner portion of the first hole and slides along the guide groove, wherein the grip arm connects the first hook of the grip member to the lever.

* * * * *